US008695178B2

(12) United States Patent
Yoneshima et al.

(10) Patent No.: US 8,695,178 B2
(45) Date of Patent: Apr. 15, 2014

(54) SLIDE FASTENER

(75) Inventors: Hisashi Yoneshima, Macon, GA (US); Kentaro Yamamoto, Macon, GA (US)

(73) Assignee: YKK Corporation

( * ) Notice: Subject to any disclaimer, the term of this patent is extended or adjusted under 35 U.S.C. 154(b) by 1294 days.

(21) Appl. No.: 12/164,659

(22) Filed: Jun. 30, 2008

(65) Prior Publication Data

US 2009/0320249 A1 Dec. 31, 2009

(51) Int. Cl.
*A44B 19/32* (2006.01)
*A44B 19/02* (2006.01)

(52) U.S. Cl.
USPC ..... 24/409; 24/389; 24/585.1

(58) Field of Classification Search
USPC ..... 24/381, 403, 409–411, 413, 414, 584.1, 24/585.1, 585.11
See application file for complete search history.

(56) References Cited

U.S. PATENT DOCUMENTS

| | | | | |
|---|---|---|---|---|
| 2,157,828 | A * | 5/1939 | Kuna | 24/409 |
| 2,371,591 | A * | 3/1945 | Cizek | 24/410 |
| 2,798,275 | A * | 7/1957 | Morin | 24/410 |
| 3,874,038 | A * | 4/1975 | Takamatsu | 24/413 |
| 4,502,190 | A * | 3/1985 | Inamura | 24/389 |
| 4,513,483 | A * | 4/1985 | Kasai | 24/409 |
| 4,520,535 | A * | 6/1985 | Kasai | 24/410 |
| 4,765,038 | A * | 8/1988 | Kasai | 24/389 |
| 6,105,214 | A | 8/2000 | Press | |
| 7,337,508 | B2 | 3/2008 | Takasawa et al. | |
| 7,353,570 | B2 * | 4/2008 | Himi | 24/405 |
| D628,123 | S | 11/2010 | Kojima et al. | |
| D632,218 | S | 2/2011 | Yamamoto et al. | |
| D657,287 | S | 4/2012 | Cheng | |
| 2004/0187277 | A1 * | 9/2004 | Akashi et al. | 24/584.1 |
| 2006/0207069 | A1 * | 9/2006 | Cheng | 24/389 |
| 2006/0260104 | A1 * | 11/2006 | Himi | 24/403 |

FOREIGN PATENT DOCUMENTS

| | | |
|---|---|---|
| EP | 1 568 290 A2 | 8/2005 |
| JP | 45-33956 | 12/1970 |
| JP | 59-42893 | 12/1984 |
| JP | Y2 63-13687 | 4/1998 |

OTHER PUBLICATIONS

European Search Report for EP Application No. 09 25 1549 dated Oct. 28, 2009.
United States Patent and Trademark Office, Notice of Allowance and Fees Due for U.S. Appl. No. 12/477,773, mailed Oct. 2, 2012, 10 pages, USA.
Office Action dated Jan. 19, 2012 for U.S. Appl. No. 12/477,773.

* cited by examiner

*Primary Examiner* — Robert J Sandy
*Assistant Examiner* — Tyler Johnson
(74) *Attorney, Agent, or Firm* — Alston & Bird LLP

(57) ABSTRACT

Various embodiments of slide fasteners include a first set of coupling elements and a second set of coupling elements configured to be removably joined together by a zipper. Each coupling element includes a first surface having a first shape and a second surface having a second shape, wherein the second surface is spaced apart from and cofaces the first surface. The first shape may be substantially triangular or substantially trapezoidal, according to various embodiments, and the second shape is substantially gear shaped. When the coupling elements of the first set and the second set are removably joined together, water is substantially prevented from leaking from the first surface to the second surface. In addition, the coupling elements are disposed on stringer tapes, and the surfaces of the stringer tapes adjacent the first surfaces of the coupling elements are laminated with a water resistant material.

22 Claims, 7 Drawing Sheets

SLIDE FASTENER

BACKGROUND OF THE INVENTION

Typically, water resistant slide fasteners include coil coupling elements that are attached to stringer tapes. However, zippers used with the coil coupling elements tend to stick and become difficult to operate at lower temperatures, making them unsuitable for use with outdoor clothing that may be worn in low temperature environments. In addition, these zippers become difficult to operate when exposed to sand, debris, or ice.

Plastic molded coupling elements are not as susceptible to sticking at lower temperatures or when exposed to sand, debris, or ice, but known plastic molded coupling elements do not repel water effectively.

Accordingly, there is a need in the art for an improved slide fastener that is water resistant.

BRIEF SUMMARY OF VARIOUS EMBODIMENTS OF THE INVENTION

Various embodiments of the invention provide a plurality of coupling elements for use with a slide fastener. Each of the coupling elements includes a first base portion, a second base portion, an engaging portion, and a front face. The first base portion is disposed adjacent a first surface of a stringer tape, and the second base portion is disposed adjacent a second surface of the stringer tape, wherein the first surface of the stringer tape is opposite the second surface of the stringer tape. In addition, the first base portion and the second base portion define a channel therebetween for receiving a longitudinal edge of the stringer tape.

The engaging portion extends outwardly from the first and the second base portions, and the engaging portion includes a first surface and a second surface. The first surface of the engaging portion is spaced apart from and cofaces the second surface of the engaging portion. The first surface of the engaging portion has a first shape, and the second surface of the engaging portion has a second shape. A portion of the second shape adjacent a distal end of the engaging portion has a width dimension that is greater than a width dimension of a portion of the first shape adjacent the distal end. Each of the width dimensions are measured in a width plane that is substantially parallel to the first surface and the second surface of the engaging portion.

The front face is disposed at the distal end of the engaging portion and extends between the first and the second surface thereof.

A first set of coupling elements are disposed on a first stringer tape, and a second set of coupling elements are disposed on a second stringer tape. A first gap is defined by the first surfaces of the engaging portions of two adjacent coupling elements in the second set, and a second gap is defined by the second surfaces of the engaging portions of the two adjacent coupling elements in the second set. In addition, a third gap is defined by the first surfaces of the engaging portions of two adjacent coupling elements in the first set, and a fourth gap is defined by the second surfaces of the engaging portions of the two adjacent coupling elements in the first set.

When the first set of coupling elements are removably joined together with the second set of coupling elements, the first surface of the engaging portion of a first coupling element in the first set is at least partially disposed within the first gap, and the second surface of the engaging portion of the first coupling element is at least partially disposed within the second gap. In addition, the first surface of the engaging portion of a second coupling element in the second set is at least partially disposed within the third gap, and the second surface of the engaging portion of the second coupling element is at least partially disposed within the fourth gap. Furthermore, the front face of the first coupling element is disposed adjacent and cofaces the longitudinal edge of the second stringer tape, and the front face of the second coupling element is disposed adjacent and cofaces the longitudinal edge of the first stringer tape.

Various embodiments of a slide fastener may include coupling elements such as those described above. In a particular embodiment, the first surfaces of the first and the second stringer tapes are laminated with a liquid resistant material. In addition, in one embodiment, the coupling elements are molded from a plastic material.

Furthermore, in one embodiment, the channel described above is a first channel, and the front face defines a second channel. When the first set of coupling elements are removably joined together with the second set of coupling elements, the second channel of the first coupling element receives a portion of the longitudinal edge of the second stringer tape between the two adjacent coupling elements in the second set, and the second channel of the second coupling element receives a portion of the longitudinal edge of the first stringer tape between the two adjacent coupling elements in the first set.

According to various embodiments, the width of the first shape decreases from the first base portion to the front face, and the second shape comprises a neck portion and a head portion. The head portion is adjacent the distal end of the engaging portion and the neck portion is disposed between the second base portion and the head portion. A width of the neck portion is less than a width of the head portion. When the first set of coupling elements are removably joined together with the second set of coupling elements, the head portion of the first coupling element is disposed between the neck portions of the two adjacent coupling elements in the second set, and the head portion of the second coupling element is disposed between the neck portions of the two adjacent coupling elements in the first set. In one embodiment, the first shape is substantially triangular, and in another embodiment, the first shape is substantially trapezoidal.

BRIEF DESCRIPTION OF THE DRAWINGS

Figure 1B:
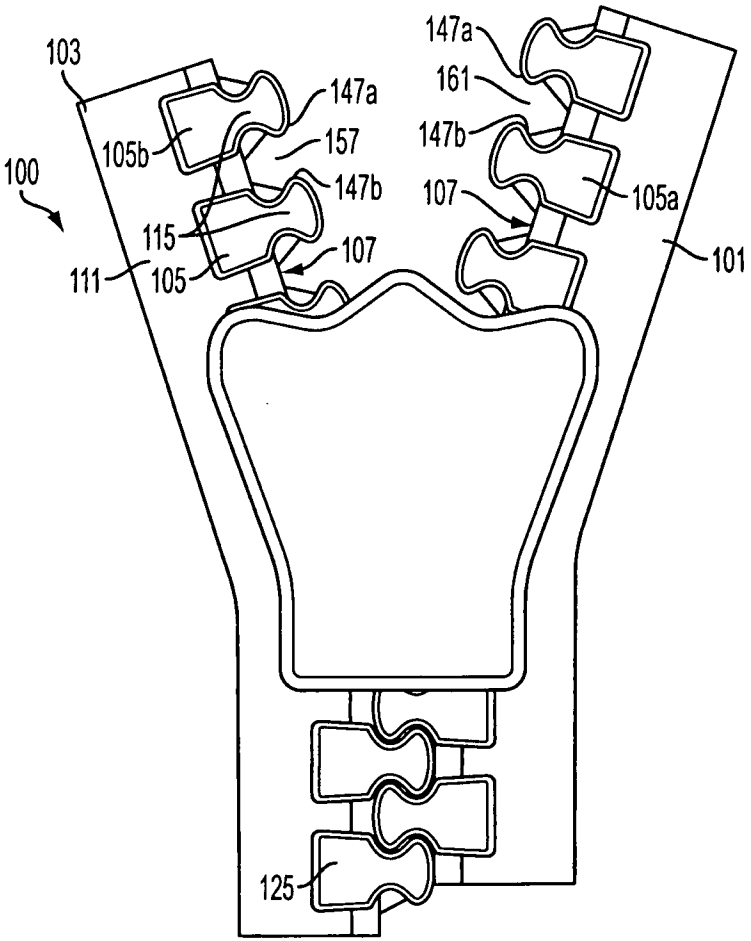
Figure 1A:
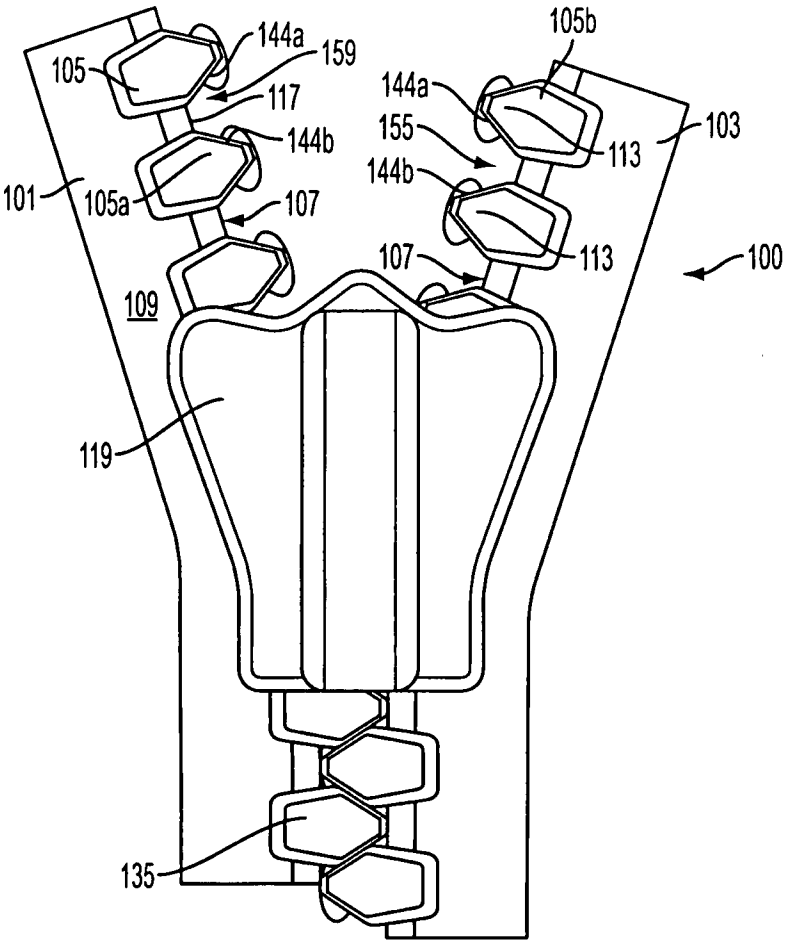

Having thus described various embodiments of the invention in general terms, reference will now be made to the accompanying drawings, which are not necessarily drawn to scale, and wherein:

FIG. 1A illustrates a plan view of a first surface of a slide fastener according to one embodiment of the invention.

FIG. 1B illustrates a plan view of a second surface of the slide fastener shown in FIG. 1A.

Figure 2A:
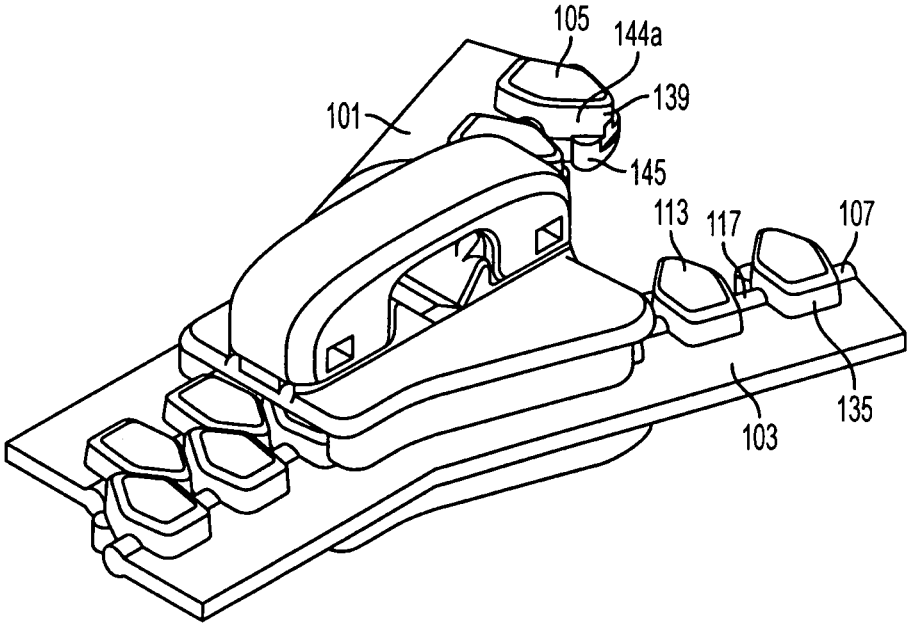

FIG. 2A illustrates a perspective view of the first surface of the slide fastener shown in FIG. 1A.

Figure 2B:
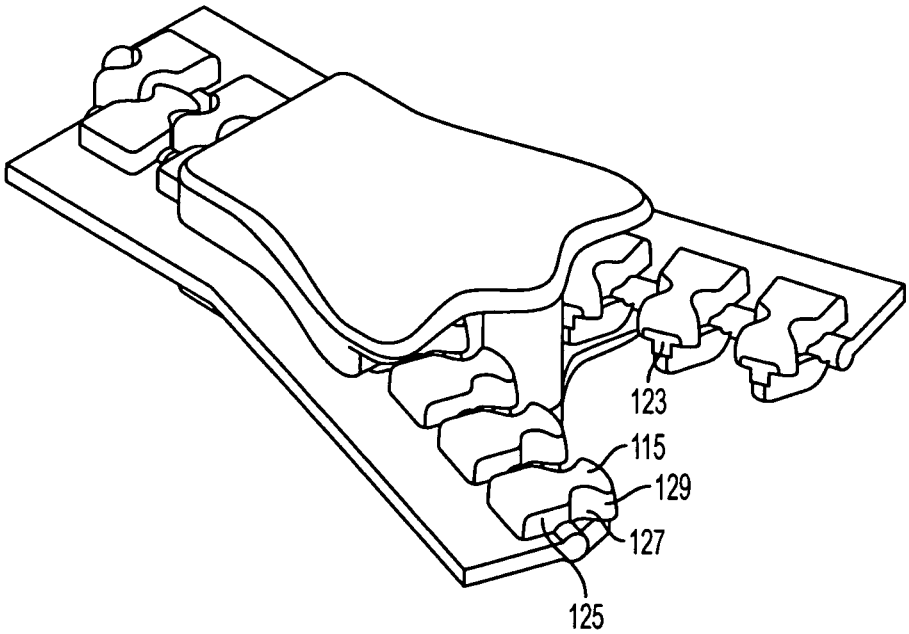

FIG. 2B illustrates a perspective view of the second surface of the slide fastener shown in FIG. 1A.

Figure 3C:
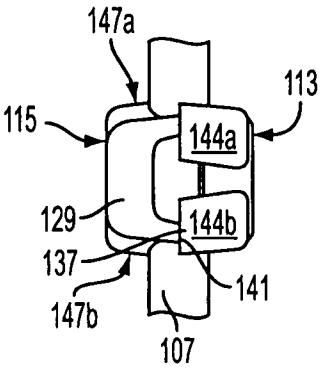
Figure 3B:
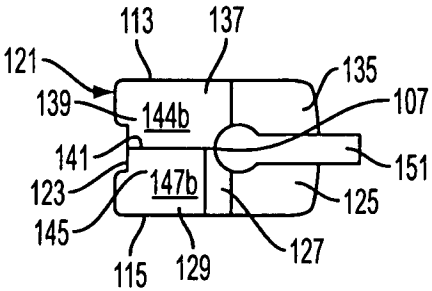
Figure 3A:
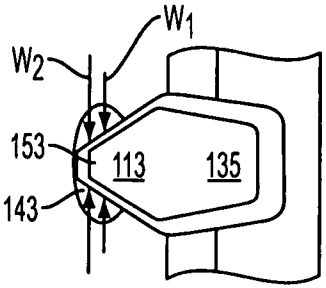

FIG. 3A illustrates a partial plan view of a coupling element molded to the first surface of the slide fastener shown in FIG. 1A.

FIG. 3B illustrates a side view of the coupling element shown in FIG. 3A.

FIG. 3C illustrates an end view of the coupling element shown in FIG. 3A.

Figure 4B:
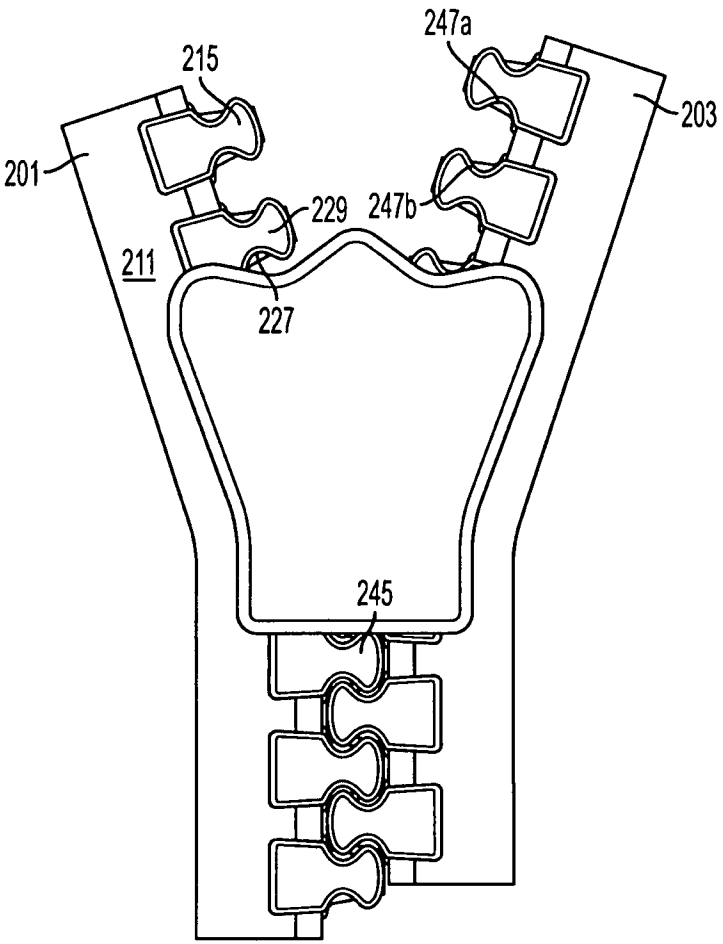
Figure 4A:
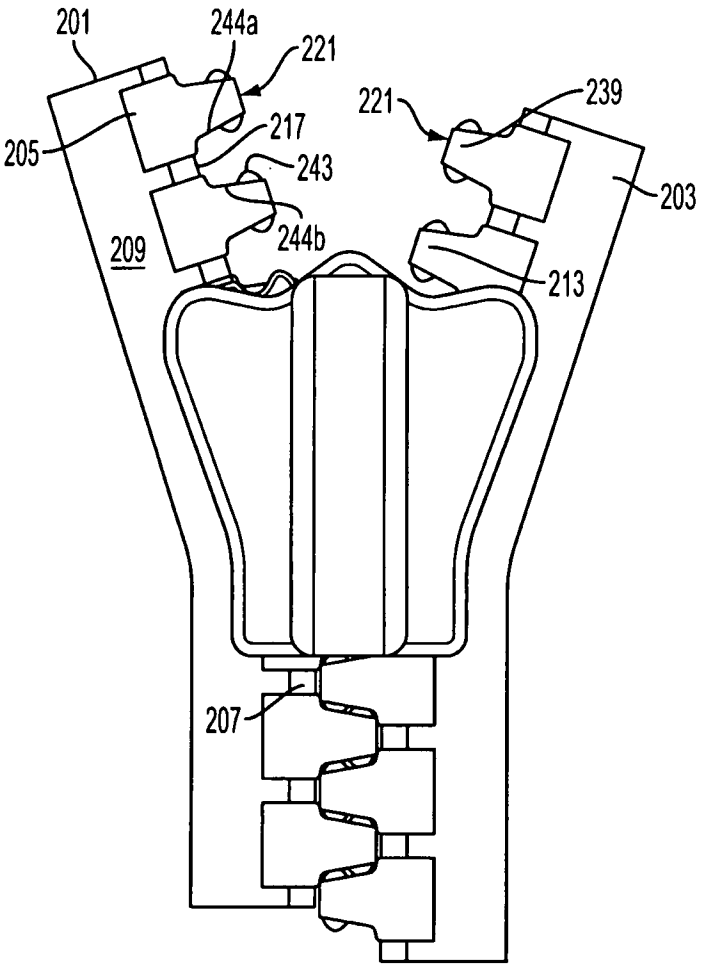

FIG. 4A illustrates a plan view of a first surface of a slide fastener according to another embodiment of the invention.

FIG. 4B illustrates a plan view of a second surface of the slide fastener shown in FIG. 4A.

Figure 5A:
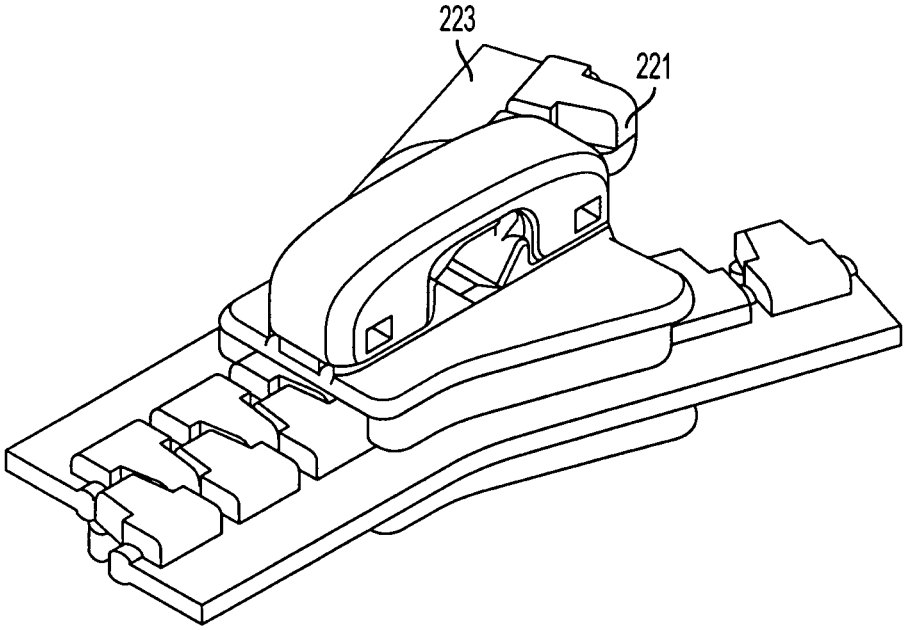

FIG. 5A illustrates a perspective view of the first surface of the slide fastener shown in FIG. 4A.

Figure 5B:
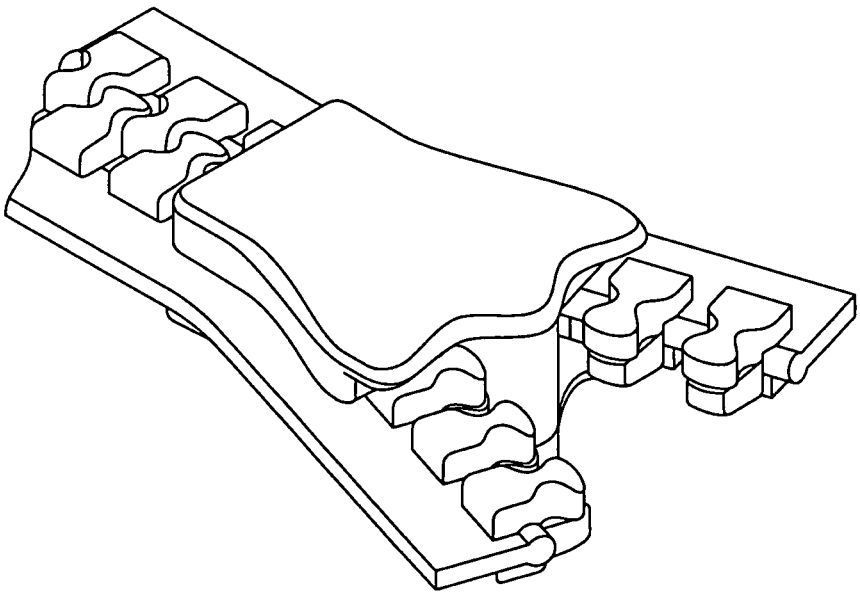
Figure 6B:
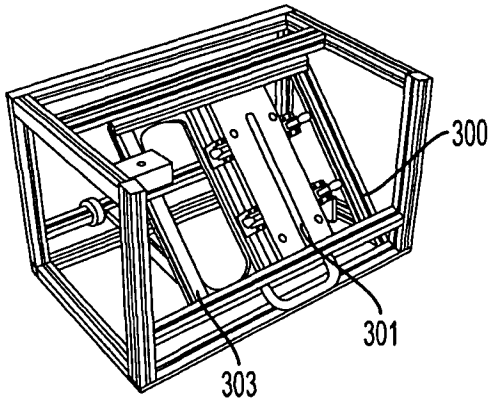
Figure 6A:
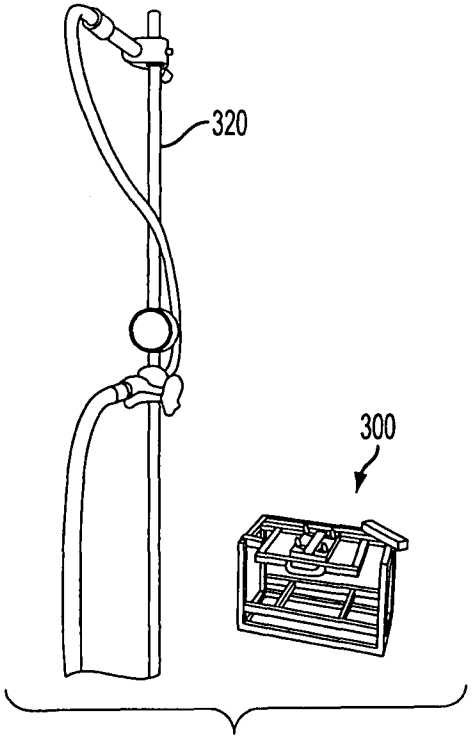
Figure 6D:
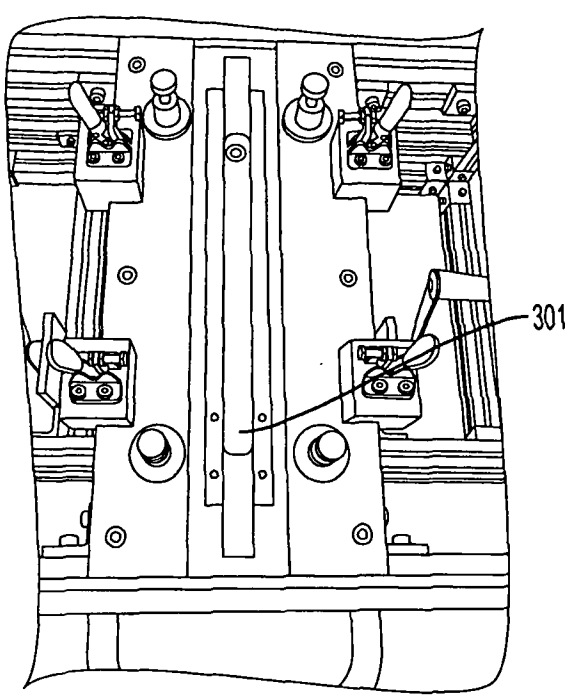
Figure 6C:
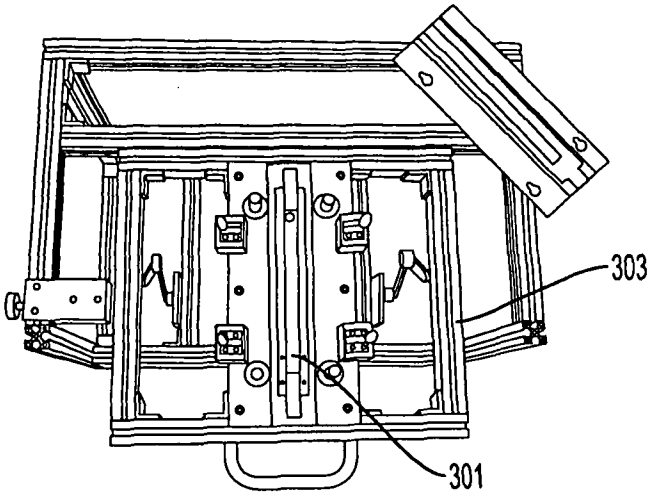

FIG. 5B illustrates a perspective view of the second surface of the slide fastener shown in FIG. 4A.

FIGS. 6A-6D illustrate exemplary test equipment for testing the water repellency of the slide fasteners shown in FIGS. 1A-5B.

DETAILED DESCRIPTION OF VARIOUS EMBODIMENTS OF THE INVENTION

Various embodiments of the invention are described more fully hereinafter with reference to the accompanying drawings, in which some, but not all embodiments of the invention are shown in the figures. These inventions may be embodied in many different forms and should not be construed as limited to the embodiments set forth herein. Rather, these embodiments are provided so that this disclosure will satisfy applicable legal requirements.

A slide fastener according to various embodiments is shown in FIGS. 1A, 1B, 2A, and 2B. The slide fastener 100 includes a first set of coupling elements 105 disposed on a first stringer tape 101 and a second set of coupling elements 105 disposed on a second stringer tape 103. The stringer tapes 101, 103 each include a first surface 109 and a second surface 111 that are opposite each other.

Each coupling element 105 includes a first base portion 135, a second base portion 125, an engaging portion 137, and a front face 121. The first base portion 135 is disposed adjacent the first surface 109 of the stringer tape 101, 103, and the second base portion 125 is disposed adjacent the second surface 111 of the stringer tape 101, 103. In addition, the first base portion 135 and the second base portion 125 define a channel 151 therebetween for receiving a longitudinal edge 107 of the stringer tape 101, 103.

The engaging portion 137 extends outwardly from the first 135 and the second base portions 125 and includes a first surface 113 and a second surface 115. The first surface 113 of the engaging portion 137 is spaced apart from and cofaces the second surface 115 of the engaging portion 137. The first surface 113 of the engaging portion 137 has a first shape and is disposed adjacent the first surface 109 of the stringer tape 101, 103, and the second surface 115 of the engaging portion 137 has a second shape and is disposed adjacent the second surface 111 of the stringer tape 101, 103. A portion of the second surface 115 of the engaging portion 137 adjacent a distal end 153 of the engaging portion 137 has a width dimension W1 that is greater than a width dimension W2 of a portion of the first surface 113 of the engaging portion 137 adjacent the distal end 153. The width dimensions are measured in a width plane that is substantially parallel to the first surface 113 and the second surface 115 of the engaging portion 137. In the embodiment shown in FIGS. 1A-3C, the first shape of the first surface 113 is substantially triangular as viewed from the first surface 109 of the stringer tape 101, 103, and the second shape of the second surface 115 is substantially gear shaped as viewed from the second surface 111 of the stringer tape 101, 103.

In an alternative embodiment shown in FIGS. 4A-5B, the first shape of the first surface 213 of the engaging portion 237 is substantially trapezoidal as viewed from the first surface 209 of the stringer tape 201, 203. According to one embodiment, coupling elements 205 having substantially trapezoidal shaped first surfaces 213 may provide better water repellency than coupling elements 105 having substantially triangular first surfaces 213. However, coupling elements 105 having substantially triangular first surfaces 115 may provide more flexibility in the plane containing the stringer tapes 101, 103 than coupling elements 205 having substantially trapezoidal first surfaces 213, according to one embodiment.

In the embodiment shown in FIGS. 1A-3C, the engaging portion 137 includes a sealing portion 139 and a fastening portion 145, and the sealing portion 139 and the fastening portion 145 abut each other at an interface 141. In particular, the sealing portion 139 extends between the first surface 113 and the interface 141, and the fastening portion 145 extends between the second surface 115 and the interface 141. In one embodiment, the interface 141 lies in a plane that is substantially parallel to the first surface 113 and the second surface 115.

As shown in FIGS. 1A and 3B-3C, the sealing portion 139 includes a first engaging face 144*a* and a second engaging face 144*b*. The first and second engaging faces 144*a*, 144*b* extend from the first surface 113 to the interface 141.

According to the embodiment shown in FIGS. 1B and 3B-3C, the fastening portion 145 includes a neck portion 127 and a head portion 129. The head portion 129 includes the front face 121, and the neck portion 127 is disposed between the second base portion 125 and the head portion 129. The neck portion 127 has a width dimension that is less than the width dimension of the head portion 129 and the second base portion 125. According to the embodiment shown in FIGS. 1A-3C, at least a portion 143 of the head portion 129 is wider in the width plane than the distal end 153 of the first surface 113 such that the portion 143 of the head portion 129 is visible when viewing the slide fastener 100 from the first side 109 of the stringer tapes 101, 103. In addition, a first fastening face 147*a* and a second fastening face 147*b* extend from the second surface 115 to the interface 141. Furthermore, the front face 121 is disposed at the distal end 153 of the engaging portion 137 and extends between the first 113 and the second surface 115 thereof.

A first gap 155 is defined by the first surfaces 113 and the engaging faces 144*a*, 144*b* of two adjacent coupling elements 105 in the second set, and a second gap 157 is defined by the second surfaces 115 and the fastening faces 147*a*, 147*b* of the two adjacent coupling elements 105 in the second set. In addition, a third gap 159 is defined by the first surfaces 113 and the engaging faces 144*a*, 144*b* of two adjacent coupling elements 105 in the first set, and a fourth gap 161 is defined by the second surfaces 115 and the fastening faces 147*a*, 147*b* of the two adjacent coupling elements 105 in the first set.

When the first set of coupling elements 105 are removably joined together with the second set of coupling elements 105, the first surface 113 of the engaging portion 137 and the sealing portion 139 of a first coupling element 105*a* in the first set are at least partially disposed within the first gap 155, and the second surface 115 of the engaging portion 137 and the fastening portion 145 of the first coupling element 105*a* are at least partially disposed within the second gap 157. In addition, the first surface 113 of the engaging portion 137 and the sealing portion 139 of a second coupling element 105*b* in the second set are at least partially disposed within the third gap 159, and the second surface 115 of the engaging portion 137 and the fastening portion 145 of the second coupling element 105*b* are at least partially disposed within the fourth gap 161. In particular, the head portions 129 of the coupling elements 105 in the first set are disposed between adjacent neck portions 127 of the coupling elements 105 in the second set, and the head portions 129 of the coupling elements 105 in the second set are disposed between adjacent neck portions 127 of the coupling elements 105 in the first set. The engagement of the head portions 129 between the neck portions 127 prevents the coupling elements 105 from inadvertently disengaging.

Furthermore, when the first set of coupling elements 105 are removably joined together with the second set of coupling elements 105, the front face 121 of the first coupling element 105*a* is disposed adjacent and cofaces the longitudinal edge 107 of the second stringer tape 103, and the front face 121 of the second coupling element 105*b* is disposed adjacent and cofaces the longitudinal edge 107 of the first stringer tape 101.

In a particular embodiment, such as shown in FIGS. 1A-3C, the engaging portions 137 of adjacent coupling elements 105 on the first stringer tape 101 are spaced apart from each other such that a portion 117 of the longitudinal edge 107 of the first stringer tape 101 is exposed between the adjacent coupling elements 105. Similarly, the engaging portions 137 of adjacent coupling elements 105 on the second stringer tape 103 are spaced apart from each other such that a portion 117 of the longitudinal edge 107 of the second stringer tape 103 is exposed between the adjacent coupling elements 105.

In addition, the first base portions 135 of the adjacent coupling elements 105 on the first coupling tape 101 may be spaced apart, and the second base portions 125 of the adjacent coupling elements 105 on the first coupling tape 101 may be spaced apart, as shown in the embodiment in FIGS. 1A-3C. Similarly, the first base portions 135 of the adjacent coupling elements 105 on the second coupling tape 103 may be spaced apart, and the second base portions 125 of the adjacent coupling elements 105 on the second coupling tape 103 may be spaced apart. However, in an alternative embodiment (not shown), the first 135 and second base portions 125 on each stringer tape 101, 103 may be formed continuously.

In addition, in the embodiment shown in FIGS. 3A and 3B, the front face 121 defines a channel 123 that is spaced apart from the channel 151 and is substantially parallel with the longitudinal edge 107. The channel 123 is configured for receiving the portion 117 of the longitudinal edge 107 of the opposite stringer tape 101, 103 when the coupling elements 105 on the stringer tapes 101, 103 are joined together.

According to various embodiments, each coupling element 105 is molded from a plastic material, such as polyester, polypropylene, polyethylene, or polyamide. However, in various other embodiments, the coupling elements may be formed of other materials, including, for example, metal, ceramic, or wood, or a combination thereof.

In addition, in one embodiment, the coupling elements 105 in the first set are molded to the first stringer tape 101, and the coupling elements 105 in the second set are molded to the second stringer tape 103. For example, in one embodiment, the coupling elements 105 are molded to the stringer tapes 101, 103 using an injection molding process. In an alternative embodiment, the coupling elements may be formed separately and attached to the stringer tapes.

According to a particular embodiment, the first surface 109 of each stringer tape 101, 103 is laminated with a liquid resistant coating. The liquid resistant coating may include, for example, polyurethane, polyester, polypropylene, nylon, poly vinyl chloride, or another type of film. In addition, the first surface 109 of each stringer tape 101, 103 is laminated prior to molding the coupling elements 105 onto the stringer tapes 101, 103, according to a particular embodiment. However, in an alternative embodiment in which an ultra flexible and stretchable film is used in the lamination process, the lamination step may occur after the coupling elements 105 are molded to the stringer tapes 101, 103.

The stringer tapes 101, 103 are attached to an article having two seams to be joined together (e.g., clothing or bag) such that first surfaces 109 of stringer tapes 101, 103 and the first surfaces 113 of the coupling elements 105 are disposed adjacent an outside of the article and the second surfaces 111 of the stringer tapes 101, 103 and the second surfaces 115 of the coupling elements 105 are disposed adjacent an inside of the article. A zipper 119 is urged over the coupling elements 105 in a first direction to join the coupling elements 105 on each stringer tape 101, 103 into engagement with each other, and the zipper 119 is urged in a second direction opposite the first direction to disengage the coupling elements 105 on each stringer tape 101, 103.

The embodiments shown in FIGS. 1A-5B are substantially water resistant. In particular, when the coupling elements 105, 205 are engaged, liquids (e.g., water) are substantially prevented from leaking from the first surface 109, 209 of each stringer tape 101, 103, 201, 203 and the first surface 113, 213 of each coupling element 105, 205 to the second surface 111, 213 of each stringer tape 101, 103, 201, 203 and the second surface 115, 215 of each coupling element 105, 205. In particular, according to the embodiments shown in FIGS. 1A-5B, the liquid resistant coating on the first surfaces 109, 209 of the stringer tapes 101, 103, 201, 203 substantially prevents liquids, such as water, from penetrating through the stringer tapes 101, 103, 201, 203. Liquids are also prevented from penetrating between adjacent coupling elements 105, 205 disposed on opposite stringer tapes 101, 103, 201, 203 by the engagement of the engaging faces 144*a*, 144*b*, 244*a*, 244*b* of the sealing portions 139, 239 of the coupling elements 105, 205. In addition, liquid that may penetrate between adjacent engaging faces 144*a*, 144*b*, 244*a*, 244*b* of the coupling elements 105, 205 is prevented from moving to the second surfaces 111, 211 of the stringer tapes 101, 103, 201, 203 and the second surfaces of the 115, 215 of the coupling elements 105, 205 by the portion 143, 243 of the head portion 129, 229 adjacent the interface 141, 241 between the sealing portion 139, 239 and the fastening portion 145, 245. Furthermore, liquids are substantially prevented from penetrating through the interface between the front face 121, 221 of each coupling element 105, 205 and the longitudinal edge 107, 207 of the opposite stringer tape 101, 103, 201, 203 by the engagement of the channel 123, 223 with the portion 117, 217 of the longitudinal edge 107, 207 between adjacent engaging portions 137, 237.

The embodiment of the slide fasteners 100, 200 shown in FIGS. 1A-5B were subjected to a water repellency test, and both embodiments 100, 200 prevented less than 0.5 cubic centimeters (cc) of water per fifteen minutes from passing through the slide fasteners 100, 200. In particular, as shown in FIGS. 6A-6D, the water repellency test included securing the slide fastener 100, 200 to an opening 301 in a box 300 such that the first surface 109, 209 of each stringer tape 101, 103, 201, 203 faced the outside of the box 300 and the second surface 111, 211 of each stringer tape 101, 103, 201, 203 faced the inside of the box 300. The opening 301 was defined in a side face 303 of the box 300, and the side face 303 of the box 300 was disposed at an angle to a top surface of the box 300. A water source 320, such as a shower, was positioned adjacent the box 300 such that the water flowing from the water source 320 approached the side face 303 at substantially 45°. The water source 320 released water at a rate of approximately 100 mm/hour. After approximately fifteen minutes, the water inside the box 300 was measured to determine the ability of the slide fastener 100, 200 to repel water. As noted above, less than 0.5 cc of water passed through the slide fasteners 100, 200 during the test.

CONCLUSION

Although this invention has been described in specific detail with reference to the disclosed embodiments, it will be understood that many variations and modifications may be effected within the spirit and scope of the invention as described in the appended claims.

The invention claimed is:

1. A plurality of coupling elements for use with a slide fastener, each of said coupling elements comprising:

a first base portion disposed adjacent a first surface of a stringer tape and a second base portion disposed adjacent a second surface of said stringer tape, said second surface of said stringer tape being opposite said first surface of said stringer tape, and said first base portion and said second base portion defining a first channel therebetween for receiving a longitudinal edge of said stringer tape;

an engaging portion extending outwardly from said first and said second base portions, said engaging portion comprising a first surface, a second surface, a sealing portion and a fastening portion, wherein said sealing portion and said fastening portion abut each other at an interface, wherein said sealing portion extends from said first surface to said interface and said fastening portion extends from said second surface to said interface, said first surface of said engaging portion being spaced apart from and cofacing said second surface of said engaging portion, and said first surface of said engaging portion having a first shape and said second surface of said engaging portion having a second shape, wherein a portion of said second surface adjacent a distal end of said engaging portion has a width dimension that is greater than a width dimension of a portion of said first surface adjacent said distal end, each of said width dimensions being measured in a width plane that is substantially parallel to said first surface and said second surface of said engaging portion; and a front face being disposed at said distal end of said engaging portion and extending between said first and said second surfaces thereof, said front face defining a second channel at said interface, wherein:

a first set of coupling elements are disposed on a first stringer tape and a second set of coupling elements are disposed on a second stringer tape, a first gap is defined by said first surfaces of said engaging portions of two adjacent coupling elements in said second set, a second gap is defined by said second surfaces of said engaging portions of said two adjacent coupling elements in said second set, a third gap is defined by said first surfaces of said engaging portions of two adjacent coupling elements in said first set, a fourth gap is defined by said second surfaces of said engaging portions of said two adjacent coupling elements in said first set, and when said first set of coupling elements are removably joined together with said second set of coupling elements, said first surface of said engaging portion of a first coupling element in said first set is at least partially disposed within said first gap and said second surface of said engaging portion of said first coupling element is at least partially disposed within said second gap, said first surface of said engaging portion of a second coupling element in said second set is at least partially disposed within said third gap and said second surface of said engaging portion of said second coupling element is at least partially disposed within said fourth gap, said front face of said first coupling element is disposed adjacent and cofacing said longitudinal edge of said second stringer tape, and said front face of said second coupling element is disposed adjacent and cofacing said longitudinal edge of said first stringer tape, wherein said second channel of said first coupling element receives a portion of the longitudinal edge of the second stringer tape between the two adjacent coupling elements in the second set, and said second channel of said second coupling element receives a portion of the longitudinal edge of the first stringer tape between the two adjacent coupling elements in the first set, said width of said first shape decreases from said base portion to said front face, and said second shape comprises a neck portion and a head portion, wherein said head portion is adjacent said distal end of said engaging portion and said neck portion is disposed between said base portion and said head portion, and wherein a width of said neck portion is less than a width of said head portion.

2. The coupling elements of claim 1 wherein when said first set of coupling elements are removably joined together with said second set of coupling elements, said head portion of said first coupling element is disposed between said neck portions of said two adjacent coupling elements in said second set and said head portion of said second coupling element is disposed between said neck portions of said two adjacent coupling elements in said first set.

3. The coupling elements of claim 2 wherein said first shape is substantially triangular.

4. The coupling elements of claim 2 wherein said first shape is substantially trapezoidal.

5. The coupling elements of claim 1 wherein said coupling elements are molded from a plastic material.

6. The coupling elements of claim 1 wherein said interface lies in a plane that is substantially parallel to said first surface and said second surface.

7. The coupling elements of claim 1 wherein said sealing portion comprises a first engaging face and a second engaging face and said fastening portion comprises a first fastening face and a second fastening face.

8. The coupling elements of claim 7 wherein:

said coupling elements further comprise a third coupling element in said first set and a fourth coupling element in said second set, said third coupling element being disposed adjacent said first coupling element on said first stringer tape, and said fourth coupling element being disposed adjacent said second coupling element on said second stringer tape, and said first gap is further defined by said first engaging face of said second coupling element and said second engaging face of said fourth coupling element, said second gap is further defined by said first fastening face of said second coupling element and said second fastening face of said fourth coupling element, said third gap is further defined by said second engaging face of said first coupling element and said first engaging face of said third coupling element, and said fourth gap is further defined by said second fastening face of said first coupling element and said first fastening face of said third coupling element.

9. A slide fastener comprising:

a first stringer tape and a second stringer tape, each stringer tape having a longitudinal edge and a first surface and a second surface, said second surface being opposite said first surface; and a first set of coupling elements disposed adjacent said first stringer tape, wherein each of said coupling elements comprises:

a first base portion disposed adjacent said first surface of said first stringer tape and a second base portion disposed adjacent said second surface of said first stringer tape, and said first base portion and said second base portion defining a first channel therebetween for receiving said longitudinal edge of said first stringer tape;

an engaging portion extending outwardly from said first and said second base portions, said engaging portion comprising a first surface and a second surface, said first surface of said engaging portion being spaced apart from and cofacing said second surface of said engaging portion, and said first surface of said engaging portion having a first shape and said second surface of said engaging portion having a second shape, wherein a portion of said second shape adjacent a distal end of said engaging portion has a width dimension that is greater than a width dimension of a portion of said first shape adjacent said distal end, each of said width dimensions being measured in a width plane that is substantially parallel to said first surface and said second surface of said engaging portion; and a front face disposed at said distal end of said engaging portion and extending between said first and said second surface thereof; and a second set of coupling elements disposed adjacent said second stringer tape, wherein each of said coupling elements comprises:

a first base portion disposed adjacent said first surface of said second stringer tape and a second base portion disposed adjacent said second surface of said second stringer tape, and said first base portion and said second base portion defining a first channel therebetween for receiving said longitudinal edge of said second stringer tape;

an engaging portion extending outwardly from said first and said second base portions, said engaging portion comprising a first surface and a second surface, a sealing portion and a fastening portion, said sealing portion and said fastening portion abut each other at an interface, wherein said sealing portion extends from said first surface to said interface and said fastening portion extends from said second surface to said interface, said first surface of said engaging portion being spaced apart from and cofacing said second surface of said engaging portion, and said first surface of said engaging portion having a first shape and said second surface of said engaging portion having a second shape, wherein a portion of said second shape adjacent a distal end of said engaging portion has a width dimension that is greater than a width dimension of a portion of said first shape adjacent said distal end, each of said width dimensions being measured in a width plane that is substantially parallel to said first surface and said second surface of said engaging portion; and a front face disposed at said distal end of said engaging portion and extending between said first and said second surfaces thereof, said front face defining a second channel at said interface, wherein:

a first gap is defined by said first surfaces of said engaging portions of two adjacent coupling elements in said second set, a second gap is defined by said second surfaces of said engaging portions of said two adjacent coupling elements in said second set, a third gap is defined by said first surfaces of said engaging portions of two adjacent coupling elements in said first set, a fourth gap is defined by said second surfaces of said engaging portions of said two adjacent coupling elements in said first set, and when said first set of coupling elements are removably joined together with said second set of coupling elements, said first surface of said engaging portion of a first coupling element in said first set is at least partially disposed within said first gap and said second surface of said engaging portion of said first coupling element is at least partially disposed within said second gap, said first surface of said engaging portion of a second coupling element in said second set is at least partially disposed within said third gap and said second surface of said engaging portion of said second coupling element is at least partially disposed within said fourth gap, said front face of said first coupling element is disposed adjacent and cofacing said longitudinal edge of said second stringer tape, and said front face of said second coupling element is disposed adjacent and cofacing said longitudinal edge of said first stringer tape, wherein further said second channel of said first coupling element receives a portion of the longitudinal edge of the second stringer tape between the two adjacent coupling elements in the second set, and said second channel of said second coupling element receives a portion of the longitudinal edge of the first stringer tape between the two adjacent coupling elements in the first set, said width of said first shape decreases from said base portion to said front face, and said second shape comprises a neck portion and a head portion, wherein said head portion is adjacent said distal end of said engaging portion and said neck portion is disposed between said base portion and said head portion, and wherein a width of said neck portion is less than a width of said head portion.

10. The slide fastener of claim 9 wherein said first surfaces of said first and said second stringer tapes are laminated with a water resistant material.

11. The slide fastener of claim 9 wherein when said first set of coupling elements are removably joined together with said second set of coupling elements, said head portion of said first coupling element is disposed between said neck portions of said two adjacent coupling elements in said second set and said head portion of said second coupling element is disposed between said neck portions of said two adjacent coupling elements in said first set.

12. The slide fastener of claim 11 wherein said first shape is substantially triangular.

13. The slide fastener of claim 11 wherein said first shape is substantially trapezoidal.

14. The slide fastener of claim 9 wherein said coupling elements are molded from a plastic material.

15. The slide fastener of claim 9 wherein said longitudinal edge of each of said first and second stringer tapes is a first longitudinal edge and each of said first and second stringer tapes further comprise a second longitudinal edge opposite said first longitudinal edge, said second longitudinal edge being configured for attaching to an article such that said first surfaces of said first and second stringer tapes are disposed adjacent an outer surface of said article and said second surfaces of said first and second stringer tapes are disposed adjacent an inner surface of said article.

16. The slide fastener of claim 9 wherein said interface lies in a plane that is substantially parallel to said first surface and said second surface.

17. The slide fastener of claim 9 wherein said sealing portion comprises a first engaging face and a second engaging face and said fastening portion comprises a first fastening face and a second fastening face.

18. The slide fastener of claim 17 wherein:

said coupling elements further comprise a third coupling element in said first set and a fourth coupling element in said second set, said third coupling element being disposed adjacent said first coupling element on said first stringer tape, and said fourth coupling element being disposed adjacent said second coupling element on said second stringer tape, and said first gap is further defined by said first engaging face of said second coupling element and said second engaging face of said fourth coupling element, said second gap is further defined by said first fastening face of said second coupling element and said second fastening face of said fourth coupling element, said third gap is further defined by said second engaging face of said first coupling element and said first engaging face of said third coupling element, and said fourth gap is further defined by said second fastening face of said first coupling element and said first fastening face of said third coupling element.

19. The slide fastener of claim 1 wherein a distance (a) between the front face of the first coupling element and the longitudinal edge of the first fastener stringer tape where the first coupling element is mounted, or (b) between the second coupling element and the second fastener stringer tape where the second coupling element is mounted, is equal to or greater than a distance between the opposed longitudinal edges of the first and the second stringer tapes when the slide fastener is closed.

20. The slide fastener of claim 19, wherein the engaging portion of each coupling element comprises a sealing portion and a fastening portion, and wherein a front face of the sealing portion and the fastening portion contacts the longitudinal edge of the opposing stringer tape.

21. The slide fastener of claim 9 wherein a distance (a) between the front face of the first coupling element and the longitudinal edge of the first fastener stringer tape where the first coupling element is mounted, or (b) between the second coupling element and the second fastener stringer tape where the second coupling element is mounted, is equal to or greater than a distance between the opposed longitudinal edges of the first and the second stringer tapes when the slide fastener is closed.

22. The slide fastener of claim 21 wherein the engaging portion of each coupling element comprises a sealing portion and a fastening portion, and a front face of the sealing portion and the fastening portion contacts the longitudinal edge of the opposing stringer tape.

* * * * *